US010844886B2

(12) United States Patent
Kondo et al.

(10) Patent No.: US 10,844,886 B2
(45) Date of Patent: Nov. 24, 2020

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Makoto Ito, Kobe (JP); Naoki Hata, Akashi (JP); Hideyasu Muraoka, Akashi (JP); Hitoshi Nakagawa, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/473,174

(22) PCT Filed: Dec. 18, 2017

(86) PCT No.: PCT/JP2017/045346
§ 371 (c)(1),
(2) Date: Jun. 24, 2019

(87) PCT Pub. No.: WO2018/117028
PCT Pub. Date: Jun. 28, 2018

(65) Prior Publication Data

US 2019/0323527 A1 Oct. 24, 2019

(30) Foreign Application Priority Data

Dec. 22, 2016 (JP) ..... 2016-249463

(51) Int. Cl.
*F15B 21/14* (2006.01)
*F15B 11/024* (2006.01)
*E02F 9/22* (2006.01)

(52) U.S. Cl.
CPC ..... *F15B 21/14* (2013.01); *F15B 11/024* (2013.01); *E02F 9/2217* (2013.01); *F15B 2211/88* (2013.01)

(58) Field of Classification Search
CPC .... F15B 21/14; F15B 2211/88; F15B 11/028; F15B 11/024; F15B 2011/0243; E02F 9/2296
See application file for complete search history.

(56) References Cited

U.S. PATENT DOCUMENTS 10,344,784 B2 * 7/2019 Peterson ..... E02F 9/2289
2009/0288408 A1 11/2009 Tozawa et al.

FOREIGN PATENT DOCUMENTS

CN 101091065 A 12/2007
JP 2003-056507 A 2/2003

* cited by examiner

*Primary Examiner* — Abiy Teka
(74) *Attorney, Agent, or Firm* — Oliff PLC

(57) ABSTRACT

A hydraulic system includes: a control valve connected to a pump and a tank; a cylinder connected to the control valve by a rod-side and a head-side supply lines; a recycle line connects the rod-side to the head-side supply lines; a recycle valve on the recycle line being opened at a time of extending the cylinder and closed at a time of retracting the cylinder; a switching valve on the recycle line between the recycle valve and the head-side supply line being switched to a first state at the time of extending the cylinder and switched to a second state at the time of retracting the cylinder; a release line branches off from the recycle line at a position between the recycle and switching valves, and connects to the tank; and a release valve closed at the time of extending the cylinder and opened when retracting the cylinder.

4 Claims, 2 Drawing Sheets

HYDRAULIC SYSTEM

TECHNICAL FIELD

The present invention relates to a hydraulic system.

BACKGROUND ART

Conventionally, a hydraulic system including a hydraulic actuator is used in, for example, construction machines and industrial machines. For example, Patent Literature 1 discloses a hydraulic system 100 incorporated in a hydraulic excavator as shown in FIG. 2.

Specifically, the hydraulic excavator incorporating the hydraulic system 100 therein is intended for excavating deep into the ground. The hydraulic excavator includes a bucket that is lifted and lowered in the vertical direction by a telescopic arm. The telescopic arm is swingably coupled to the distal end of a boom. The telescopic arm is swung by an arm cylinder (not shown), and also, extended/retracted by an arm extending/retracting cylinder 140.

The arm extending/retracting cylinder 140 is connected to a control valve 120 by a head-side supply line 131 and a rod-side supply line 132. The control valve 120 is connected to a pump 110 by a pump line 111 and to a tank by a tank line 112.

The hydraulic system 100 is further provided with a recycle line 150 and a release line 160. The recycle line 150 connects the rod-side supply line 132 to the head-side supply line 131. The release line 160 branches off from the head-side supply line 131, and connects to the tank.

The recycle line 150 is provided with a recycle valve 151, which is closed at the time of retracting the arm extending/retracting cylinder 140 and is opened at the time of extending the arm extending/retracting cylinder 140. The recycle line 150 is further provided with a check valve 152 positioned between the recycle valve 151 and the rod-side supply line 132. The check valve 152 allows a flow from the rod-side supply line 132 toward the head-side supply line 131, and blocks the reverse flow. Accordingly, at the time of extending the arm extending/retracting cylinder 140, a hydraulic fluid discharged from a rod chamber 142 returns to the tank by flowing through the control valve 120 and the tank line 112. At the time, if the pressure of a head chamber 141 is lower than the pressure of the rod chamber 142, a part of the hydraulic fluid discharged from the rod chamber 142 flows through the recycle line 150 to be supplied to the head chamber 141 for recycling use of the part of the hydraulic fluid.

The release line 160 is provided with a switching valve 161, which is closed at the time of extending the arm extending/retracting cylinder 140 and is opened at the time of retracting the arm extending/retracting cylinder 140. Accordingly, at the time of retracting the arm extending/retracting cylinder 140, the hydraulic fluid discharged from the head chamber 141 of the arm extending/retracting cylinder 140 returns to the tank by flowing through the release line 160, and also, returns to the tank by flowing through the control valve 120 and the tank line 112. As a result, the back pressure of the arm extending/retracting cylinder 140 is reduced.

CITATION LIST

Patent Literature

PTL 1: Japanese Laid-Open Patent Application Publication No. 2003-56507

SUMMARY OF INVENTION

Technical Problem

However, in the hydraulic system 100 shown in FIG. 2, at the time of retracting the arm extending/retracting cylinder 140, the recycle line 150 does not function, and the function thereof is wasted. Moreover, since the release line 160 branches off from the head-side supply line 131, a space is required for the additional hydraulic fluid passage, and consequently, the size of a casing accommodating the valves of the hydraulic system 100 increases.

In view of the above, an object of the present invention is to provide a hydraulic system that makes it possible to utilize the recycle line even at the time of retracting the cylinder.

Solution to Problem

In order to solve the above-described problems, a hydraulic system according to the present invention includes: a control valve that is connected to a pump by a pump line and to a tank by a tank line; a cylinder that is connected to the control valve by a rod-side supply line and a head-side supply line; a recycle line that connects the rod-side supply line to the head-side supply line; a recycle valve that is provided on the recycle line, the recycle valve being opened at a time of extending the cylinder and closed at a time of retracting the cylinder; a switching valve that is provided on the recycle line at a position between the recycle valve and the head-side supply line, the switching valve being switched to a first state at the time of extending the cylinder and switched to a second state at the time of retracting the cylinder, such that when the switching valve is in the first state, the switching valve allows a flow of a hydraulic fluid from the recycle valve toward the head-side supply line, and blocks a flow of the hydraulic fluid from the head-side supply line toward the recycle valve, and when the switching valve is in the second state, the switching valve allows the flow of the hydraulic fluid from the head-side supply line toward the recycle valve; a release line that branches off from the recycle line at a position between the recycle valve and the switching valve, and connects to the tank; and a release valve that is provided on the release line, the release valve being closed at the time of extending the cylinder and opened at the time of retracting the cylinder.

According to the above configuration, at the time of extending the cylinder, the hydraulic fluid discharged from a rod chamber of the cylinder returns to the tank by flowing through the control valve and the tank line. At the time, if the pressure of a head chamber is lower than the pressure of the rod chamber, a part of the hydraulic fluid discharged from the rod chamber of the cylinder flows through the recycle line (the recycle valve and the switching valve) to be supplied to the head chamber for recycling use of the part of the hydraulic fluid. On the other hand, at the time of retracting the cylinder, the hydraulic fluid discharged from the head chamber of the cylinder returns to the tank by flowing through a part of the recycle line (the part including the switching valve) and the release line (the release valve), and also, returns to the tank by flowing through the control valve and the tank line. This makes it possible to reduce the back pressure of the cylinder by utilizing the recycle line at the time of retracting the cylinder.

For example, the hydraulic system may be incorporated in a hydraulic excavator. The cylinder may be an arm cylinder, and arm crowding to bring an arm closer to a cabin may be performed by extending the arm cylinder.

At the time of extending the cylinder, if a discharge pressure of the pump is higher than a first threshold or if a pressure of a head chamber of the cylinder is higher than a second threshold, the release valve may be opened. According to this configuration, when the recycling is unnecessary at the time of extending the cylinder, the pressure of the rod chamber of the cylinder can be prevented from increasing.

Advantageous Effects of Invention

The present invention makes it possible to utilize the recycle line even at the time of retracting the cylinder.

DESCRIPTION OF EMBODIMENTS

Figure 1:
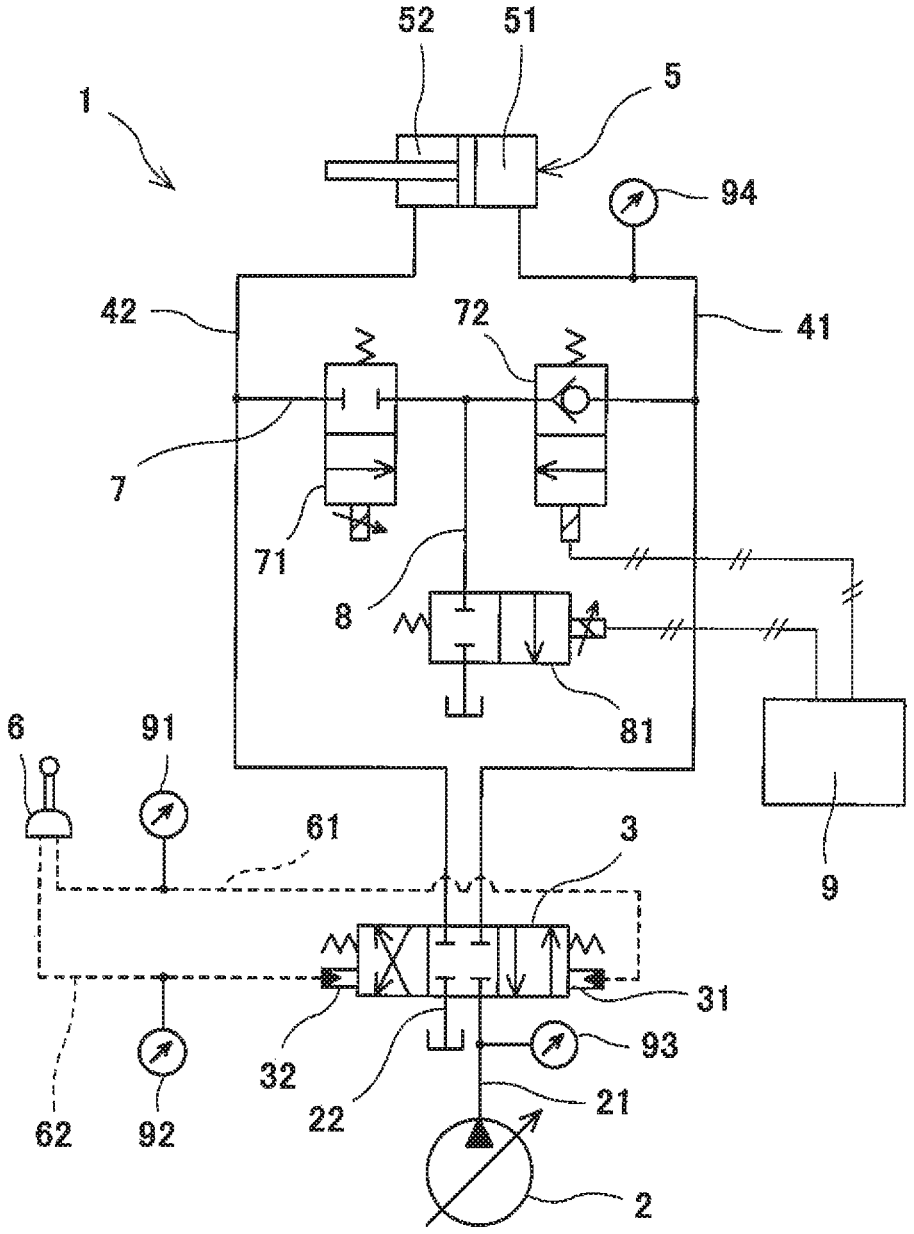
FIG. 1 shows a schematic configuration of a hydraulic system according to one embodiment of the present invention.
Figure 2:
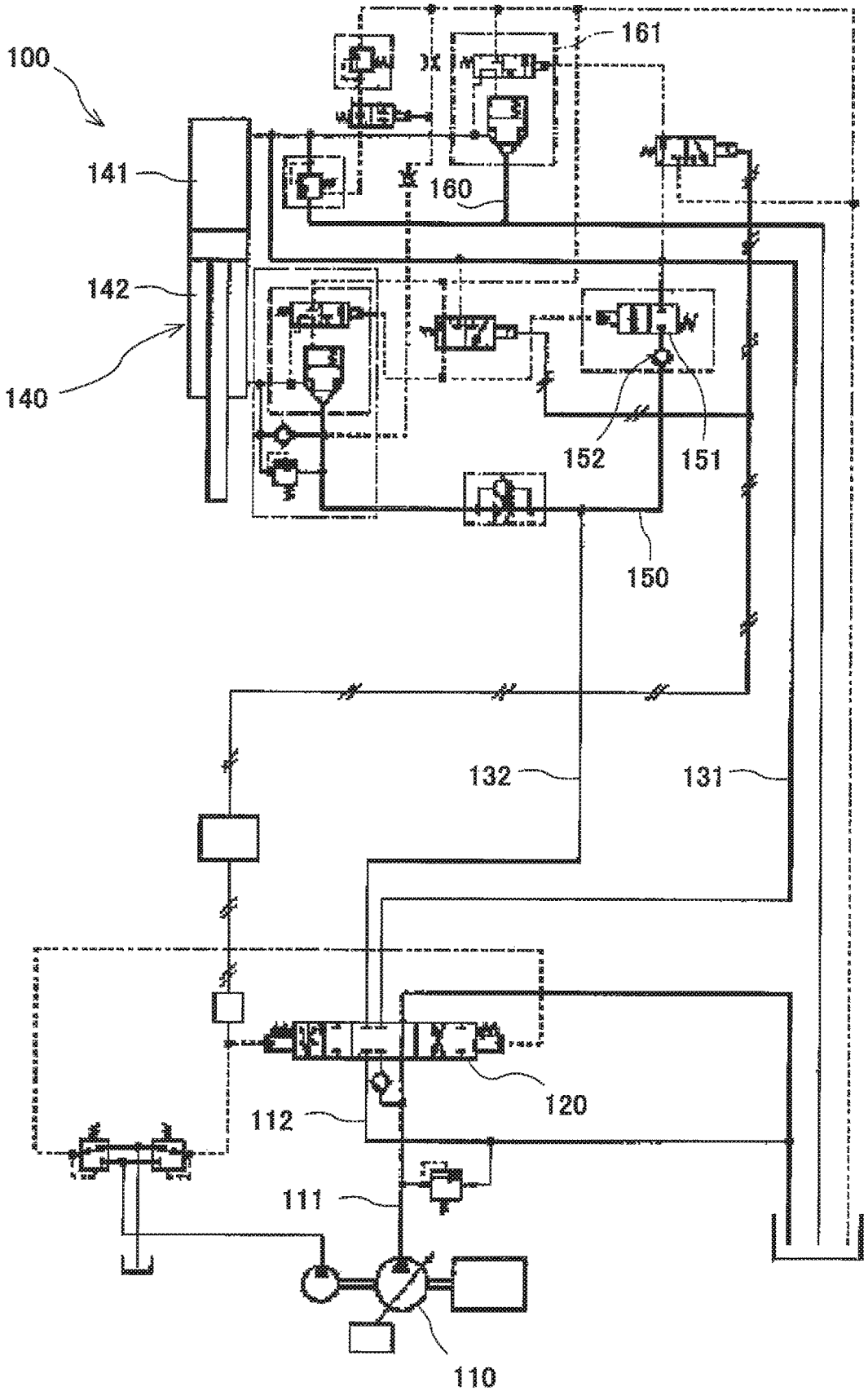
FIG. 2 shows a schematic configuration of a conventional hydraulic system.

FIG. 1 shows a hydraulic system 1 according to one embodiment of the present invention. At the time of extending a cylinder 5, the hydraulic system 1 supplies a hydraulic fluid discharged from a rod chamber 52 of the cylinder 5 to a head chamber 51 thereof for recycling use of the hydraulic fluid. The hydraulic fluid is typically oil, but may be a different type of fluid (e.g., water).

The hydraulic system 1 may be incorporated in a construction machine, such as a hydraulic excavator or hydraulic crane, or may be incorporated in an industrial machine. For example, in a case where the hydraulic system 1 is incorporated in a hydraulic excavator, the cylinder 5, for which the hydraulic fluid is recycled, may be an arm cylinder that swings an arm. In this case, desirably, arm crowding to bring the arm closer to a cabin (the cabin is a part of a turning unit) is performed by extending the arm cylinder. Alternatively, arm pushing to move the arm away from the cabin may be performed by extending the arm cylinder. Further alternatively, in a case where the hydraulic system 1 is incorporated in a hydraulic excavator, the cylinder 5, for which the hydraulic fluid is recycled, may be a bucket cylinder that swings a bucket.

The cylinder 5 is supplied with the hydraulic fluid from a pump 2 via a control valve 3. The control valve 3 controls the supply and discharge of the hydraulic fluid to and from the cylinder 5. In the illustrated example, the pump 2 is a variable displacement pump. However, as an alternative, the pump 2 may be a fixed displacement pump.

Specifically, the control valve 3 is connected to the pump 2 by a pump line 21 and to a tank by a tank line 22. The control valve 3 is connected to the head chamber 51 of the cylinder 5 by a head-side supply line 41 and to the rod chamber 52 of the cylinder 5 by a rod-side supply line 42.

The control valve 3 is switched between a neutral position and first and second positions. When the control valve 3 is in the neutral position, the control valve 3 blocks all the lines 21, 22, 41, and 42 connected to the control valve 3. When the control valve 3 is in the first position (right-side position in FIG. 1), the control valve 3 allows the head-side supply line 41 to be in communication with the pump line 21 and allows the rod-side supply line 42 to be in communication with the tank line 22. When the control valve 3 is in the second position (left-side position in FIG. 1), the control valve 3 allows the rod-side supply line 42 to be in communication with the pump line 21 and allows the head-side supply line 41 to be in communication with the tank line 22. It should be noted that, depending on the intended use of the cylinder 5, the control valve 3 may allow both the head-side supply line 41 and the rod-side supply line 42 to be in communication with the tank line 22 when the control valve 3 is in the neutral position.

To be more specific, the control valve 3 includes a first pilot port 31 for cylinder extension and a second pilot port 32 for cylinder retraction. The first pilot port 31 is a pilot port for switching the control valve 3 from the neutral position to the first position. The second pilot port 32 is a pilot port for switching the control valve 3 from the neutral position to the second position. The control valve 3 is switched from the neutral position to the first position or the second position by an operation device 6.

The operation device 6 includes an operating lever that receives a cylinder extension operation and a cylinder retraction operation from an operator. In the present embodiment, the operation device 6 is a pilot operation valve that outputs, as an operation signal, a pilot pressure corresponding to an inclination angle of the operating lever. Accordingly, the first pilot port 31 of the control valve 3 is connected to the operation device 6 by an extension signal pilot line 61, and the second pilot port 32 of the control valve 3 is connected to the operation device 6 by a retraction signal pilot line 62.

It should be noted that the operation device 6 may be an electrical joystick that outputs, as an operation signal, an electrical signal corresponding to the inclination angle of the operating lever. In this case, each of the first pilot port 31 and the second pilot port 32 of the control valve 3 is connected to a solenoid proportional valve.

The control valve 3 is configured such that the meter-in opening area and the meter-out opening area increase in accordance with increase in a pilot pressure outputted from the operation device 6 to the first pilot port 31 or the second pilot port 32. The extension signal pilot line 61 and the retraction signal pilot line 62 are provided with a pressure sensor 91 and a pressure sensor 92, respectively. Each of the pressure sensors 91 and 92 detects a pilot pressure outputted from the operation device 6. However, in a case where the operation device 6 is an electrical joystick, the pressure sensors 91 and 92 may be eliminated.

The hydraulic system 1 further includes a recycle line 7, which connects the rod-side supply line 42 to the head-side supply line 41. The recycle line 7 is provided with a recycle valve 71. The recycle valve 71 is switched between a closed state and an open state. When the recycle valve 71 is in the closed state, the recycle valve 71 blocks the recycle line 7. When the recycle valve 71 is in the open state, the recycle valve 71 opens the recycle line 7. In the present embodiment, the recycle valve 71 is a solenoid valve, and when an opening signal is transmitted from a controller 9 described below to the recycle valve 71, the recycle valve 71 is switched from the closed state, which is the neutral state, to the open state. It should be noted that the recycle valve 71 may be a switching valve that switches its position when receiving a hydraulic pilot signal, and the hydraulic pilot signal may be controlled by a solenoid proportional valve.

In the present embodiment, the recycle valve 71 is a valve whose degree of opening is adjustable as intended (i.e., a variable restrictor). However, as an alternative, the recycle valve 71 may be an on-off valve.

The recycle line 7 is further provided with a switching valve 72 positioned between the recycle valve 71 and the head-side supply line 41. The switching valve 72 is switched between a first state and a second state. When the switching valve 72 is in the first state, the switching valve 72 allows a flow of the hydraulic fluid from the recycle valve 71 toward the head-side supply line 41, and blocks a flow of the hydraulic fluid from the head-side supply line 41 toward the recycle valve 71. When the switching valve 72 is in the second state, the switching valve 72 allows the flow of the hydraulic fluid from the head-side supply line 41 toward the recycle valve 71. In other words, in the first state, the switching valve 72 functions as a check valve, whereas in the second state, the switching valve 72 opens the recycle line 7. In the present embodiment, the switching valve 72 is a solenoid valve, and when an opening signal is transmitted from the controller 9 to the switching valve 72, the switching valve 72 is switched from the first state, which is the neutral state, to the second state.

For example, the switching valve 72 may be formed by: a check valve; and an open/close valve provided on a bypass line that bypasses the check valve. Alternatively, the switching valve 72 may be formed by: a check valve that is kept in an open state by a pilot pressure; and an open/close valve that switches whether to output the pilot pressure to the check valve or not. Further alternatively, the switching valve 72 may be a single switching valve that switches its position when receiving a hydraulic pilot signal, and the hydraulic pilot signal may be controlled by a solenoid proportional valve.

A release line 8 branches off from the recycle line 7 at a position between the recycle valve 71 and the switching valve 72. The release line 8 connects to the tank.

The release line 8 is provided with a release valve 81. The release valve 81 is switched between a closed state and an open state. When the release valve 81 is in the closed state, the release valve 81 blocks the release line 8. When the release valve 81 is in the open state, the release valve 81 opens the release line 8. In the present embodiment, the release valve 81 is a solenoid valve, and when an opening signal is transmitted from the controller 9 to the release valve 81, the release valve 81 is switched from the closed state, which is the neutral state, to the open state. It should be noted that the release valve 81 may be a switching valve that switches its position when receiving a hydraulic pilot signal, and the hydraulic pilot signal may be controlled by a solenoid proportional valve.

In the present embodiment, the release valve 81 is a valve whose degree of opening is adjustable as intended (i.e., a variable restrictor). However, as an alternative, the release valve 81 may be an on-off valve.

The above-described recycle valve 71, switching valve 72, and release valve 81 are electrically connected to the controller 9. The controller 9 is also electrically connected to the above-described pressure sensors 91 and 92. It should be noted that FIG. 1 shows only part of signal lines for simplifying the drawing. For example, the controller 9 is a computer including a CPU and memories such as a ROM and a RAM. The CPU executes a program stored in the ROM.

At the time of extending the cylinder (in the present embodiment, when the pressure detected by the pressure sensor 91 is higher than a first threshold), the controller 9 transmits an opening signal to the recycle valve 71, whereas not at the time of extending the cylinder, the controller 9 does not transmit the opening signal to the recycle valve 71. That is, at the time of extending the cylinder, the recycle valve 71 is opened, whereas while the cylinder is stopped and at the time of retracting the cylinder, the recycle valve 71 is closed.

As described above, in the present embodiment, the recycle valve 71 is a valve whose degree of opening is adjustable as intended. Accordingly, when the recycle valve 71 is opened, the controller 9 adjusts the degree of opening of the recycle valve 71 in accordance with at least one of, for example, the following: the pilot pressure outputted from the operation device 6; the discharge pressure of the pump 2; the load pressure of the cylinder 5; and the stroke amount of the cylinder 5. The discharge pressure of the pump 2 can be detected by a pump pressure sensor 93 provided on the pump line 21. The load pressure of the cylinder 5 at the time of extending the cylinder is the pressure of the head chamber 51 of the cylinder 5, and can be detected by a pressure sensor 94 provided on the head-side supply line 41 or the head chamber 51. The stroke amount of the cylinder 5 can be detected by a stroke sensor (not shown) provided on the cylinder 5.

At the time of retracting the cylinder (in the present embodiment, when the pressure detected by the pressure sensor 92 is higher than a second threshold), the controller 9 transmits an opening signal to each of the switching valve 72 and the release valve 81, whereas not at the time of retracting the cylinder, the controller 9 does not transmit the opening signal to each of the switching valve 72 and the release valve 81. That is, at the time of retracting the cylinder, the switching valve 72 is switched to the second state, in which the switching valve 72 opens the recycle line 7, whereas while the cylinder is stopped and at the time of extending the cylinder, the switching valve 72 is switched to the first state, in which the switching valve 72 functions as a check valve. At the time of retracting the cylinder, the release valve 81 is opened, whereas while the cylinder is stopped and at the time of extending the cylinder, the release valve 81 is closed.

As described above, in the present embodiment, the release valve 81 is a valve whose degree of opening is adjustable as intended. Accordingly, when the release valve 81 is opened, the controller 9 adjusts the degree of opening of the release valve 81, such that the degree of opening of the release valve 81 gradually increases in accordance with the pilot pressure outputted from the operation device 6. The controller 9 may perform the adjustment so as to make the degree of opening of the release valve 81 as large as possible within such a range that the discharge pressure of the pump 2 does not fall below a third threshold, or within such a range that the pressure of the rod chamber 52 of the cylinder 5 does not fall below a fourth threshold.

In the hydraulic system 1 of the present embodiment with the above-described configuration, at the time of extending the cylinder 5, the hydraulic fluid discharged from the rod chamber 52 of the cylinder 5 returns to the tank by flowing through the control valve 3 and the tank line 22. Also, at the time of extending the cylinder 5, the recycle valve 71 is opened, the release valve 81 is closed, and the switching valve 72 functions as a check valve. Accordingly, if the pressure of the head chamber 51 is lower than the pressure of the rod chamber 52, a part of the hydraulic fluid discharged from the rod chamber 52 of the cylinder 5 flows through the recycle line 7 (the recycle valve 71 and the switching valve 72) to be supplied to the head chamber 51 for recycling use of the part of the hydraulic fluid. On the other hand, at the time of retracting the cylinder 5, the recycle valve 71 is closed, the switching valve 72 opens the recycle line 7, and the release valve 81 is opened. Accordingly, the hydraulic fluid discharged from the head chamber 51 of the cylinder 5 returns to the tank by flowing through a part of the recycle line 7 (the part including the switching valve 72) and the release line 8 (the release valve 81), and also, returns to the tank by flowing through the control valve 3 and the tank line 22. This makes it possible to reduce the back pressure of the cylinder 5 by utilizing the recycle line 7 at the time of retracting the cylinder 5.

(Variations)

The present invention is not limited to the above-described embodiment. Various modifications can be made without departing from the spirit of the present invention.

As one example, at the time of extending the cylinder, if it is unnecessary to recycle the hydraulic fluid discharged from the rod chamber 52 of the cylinder 5, the release valve 81 may be opened such that the opening area thereof reaches a predetermined opening area or the maximum opening area, thereby causing a part of the hydraulic fluid discharged from the rod chamber 52 of the cylinder 5 to return to the tank by flowing through a part of the recycle line 7 (the part including the recycle valve 71) and the release line 8 (the release valve 81).

As another example, at the time of extending the cylinder, if the discharge pressure of the pump 2 is higher than a first threshold or if the pressure of the head chamber 51 of the cylinder 5 is higher than a second threshold (e.g., the pressure of the rod chamber 52), the release valve 81 may be opened. That is, at the time of extending the cylinder, the release valve 81 is closed if the discharge pressure of the pump 2 is lower than the first threshold or if the pressure of the head chamber 51 of the cylinder 5 is lower than the second threshold. According to this configuration, when the recycling is unnecessary at the time of extending the cylinder, the pressure of the rod chamber 52 of the cylinder 5 can be prevented from increasing.

As yet another example, at the time of extending the cylinder, if the discharge pressure of the pump 2 is higher than a fifth threshold or the pressure of the head chamber of the cylinder 5 is higher than a sixth threshold, the recycle valve 71 may be closed. That is, at the time of extending the cylinder, the recycle valve 71 is opened if the discharge pressure of the pump 2 is lower than the fifth threshold or if the pressure of the head chamber of the cylinder 5 is lower than the sixth threshold.

REFERENCE SIGNS LIST

1 hydraulic system
2 pump
21 pump line
22 tank line
3 control valve
41 head-side supply line
42 rod-side supply line
5 cylinder
7 recycle line
71 recycle valve
8 release line
81 release valve

The invention claimed is:

1. A hydraulic system comprising:

a control valve that is connected to a pump by a pump line and to a tank by a tank line;

a cylinder that is connected to the control valve by a rod-side supply line and a head-side supply line;

a recycle line that connects the rod-side supply line to the head-side supply line;

a recycle valve that is provided on the recycle line, the recycle valve being configured to switch between a closed state and an open state, such that when the recycle valve is in the closed state, the recycle valve blocks the recycle line, and when the recycle valve is in the open state, the recycle valve opens the recycle line;

a switching valve that is provided on the recycle line at a position between the recycle valve and the head-side supply line, the switching valve being configured to switch between a first state and a second state, such that when the switching valve is in the first state, the switching valve allows a flow of a hydraulic fluid from the recycle valve toward the head-side supply line, and blocks a flow of the hydraulic fluid from the head-side supply line toward the recycle valve, and when the switching valve is in the second state, the switching valve allows the flow of the hydraulic fluid from the head-side supply line toward the recycle valve;

a release line that branches off from the recycle line at a position between the recycle valve and the switching valve, and connects to the tank;

a release valve that is provided on the release line, the release valve being configured to switch between a closed state and an open state, such that when the release valve is in the closed state, the release valve blocks the release line, and when the release valve is in the open state, the release valve opens the release line; and a controller that controls the recycle valve, the switching valve, and the release valve, wherein the controller is configured to:

at a time of extending the cylinder, switch the recycle valve to the open state, switch the switching valve to the first state, and switch the release valve to the closed state, and at a time of retracting the cylinder, switch the recycle valve to the closed state, switch the switching valve to the second state, and switch the release valve to the open state.

2. The hydraulic system according to claim 1, wherein the hydraulic system is incorporated in a hydraulic excavator, and the cylinder is an arm cylinder configured to cause arm crowding to bring an arm closer to a cabin by extending the arm cylinder.

3. The hydraulic system according to claim 2, wherein at the time of extending the cylinder, if a discharge pressure of the pump is higher than a first threshold or if a pressure of a head chamber of the cylinder is higher than a second threshold, the controller is configured to switch the release valve to the open state.

4. The hydraulic system according to claim 1, wherein at the time of extending the cylinder, if a discharge pressure of the pump is higher than a first threshold or if a pressure of a head chamber of the cylinder is higher than a second threshold, the controller is configured to switch the release valve to the open state.

* * * * *